US006141024A

United States Patent [19]

Laksono et al.

[11] Patent Number: 6,141,024

[45] Date of Patent: Oct. 31, 2000

[54] GENERATING COLOR TEXT

[75] Inventors: Indra Laksono, Richmond Hill; Antonio Asaro, Scarboro; Carl K. Mizuyabu, Thornhill, all of Canada

[73] Assignee: ATI Technologies, Inc, Thornhill, Canada

[21] Appl. No.: 08/792,784

[22] Filed: Feb. 3, 1997

[51] Int. Cl.[7] ..... G09G 5/36

[52] U.S. Cl. ..... 345/515; 345/150; 345/516; 345/186

[58] Field of Search ..... 345/150, 186, 345/204, 515, 516, 193

[56] References Cited

U.S. PATENT DOCUMENTS

| | | | |
|---|---|---|---|
| 4,730,185 | 3/1988 | Springer et al. | 340/701 |
| 5,220,312 | 6/1993 | Lumelsky et al. | 340/721 |
| 5,473,342 | 12/1995 | Tse et al. | 345/150 |
| 5,526,025 | 6/1996 | Selwan et al. | 345/516 |
| 5,612,717 | 3/1997 | Leach | 345/150 |
| 5,647,026 | 7/1997 | Kwarta | 358/457 |
| 5,670,993 | 9/1997 | Greene et al. | 345/189 |
| 5,714,970 | 2/1998 | Bos et al. | 345/88 |
| 5,805,133 | 9/1998 | Priem et al. | 345/516 |

*Primary Examiner*—Bipin Shalwala
*Assistant Examiner*—Kent Chang
*Attorney, Agent, or Firm*—Markison & Reckamp, PC

[57] ABSTRACT

A rasterizer is used with a processor capable of providing raster data indicative of a pattern of pixels to be formed on a display. Each pixel has an attribute represented by a data value. The rasterizer has a replicator connected to form at least two copies of the raster data. A graphics engine is connected to use the at least two copies to store the data values in a memory. An output circuit is connected to use the data values stored in the memory to form the pattern on the display.

8 Claims, 7 Drawing Sheets

| RASTER DATA IN DATA REGISTER 53 | RESULTANT ENTRY OF TRIPLICATED BITS IN THE HOST BUFFER 56 |
| --- | --- |
| 010010000111000000001111110000001 | (000111000000111000000000000011111)<br>(111100000000000000000000001111)<br>(111111111110000000000000000000111) |

FIG. 6

GENERATING COLOR TEXT

BACKGROUND OF THE INVENTION

The invention relates to generating color text.

As shown in FIG. 1, to display a text character (e.g., an "h" 17) on a display 16, a central processing unit (CPU) 25 of a computer system 12 typically generates both monochrome raster data 11 defining the character and an address specifying the location on the display 16 at which the character should appear. A rasterizer 14 uses the raster data 11 and address to store the character in a frame buffer 13. A digital-to-analog converter (DAC) 21 scans the frame buffer 13 to generate analog signals (e.g., RGB 15 signals) on the display 16.

As shown in FIG. 2, the raster data 11 directs the placement of foreground pixels (each pixel having a predetermined foreground color) of the character on the display 16 by defining a bit mask for a corresponding block 23 of pixels. One bit value (e.g., a logical one) sets the color of a corresponding pixel equal to a predetermined foreground color, and another bit value (e.g., a logical zero) leaves the color of the corresponding pixel unchanged (i.e., the background of the character is transparent). The size of the character (i.e., the size of the raster data 11 and the size of the pixel block 23) is a function of a user selected character size, and the particular mask defined by the raster data 11 is a function of a user selected font.

The rasterizer 14 typically has a graphics engine 10 30 (FIG. 1) which stores a color value (a value that represents the color of a pixel) for each foreground pixel in a frame buffer 13 (FIG. 3). The pixel block 23 has an associated region 19 in the frame buffer 13 that contains a color value for each pixel in the block 23.

The color value is typically defined by one or more bytes, and a copy of the color value for the predetermined foreground color is typically stored in a color register of the graphics engine 10. As an example (FIG. 4) of the format of the color value, in a True Color mode (a mode allowing over 16 million possible pixel colors), the color of each pixel is uniquely defined in a red, green and blue (RGB) color space by three bytes 15: one byte (the least significant byte) defines the blue component of the color, one byte (the second most significant byte) defines the green component of the color, and one byte (the most significant byte) defines the red component of the color. The rasterizer 14 typically has a digital-to-analog converter (DAC) 21 to convert the digital color values from the frame buffer 13 into the analog signals furnished to the display 16.

To process True Color text, the graphics engine 10 might be a twenty-four bit engine used to selectively write twenty-four bit color values to the frame buffer 13 depending on the bits of the raster data 11. In other rasterizers for True Color text, the graphics engine might be a thirty-two bit engine used to selectively write thirty-two bit color values (a twenty-four bit color value and eight bits of padding) to the frame buffer 13 for each pixel.

Some rasterizers process True Color text by using an eight bit graphics engine and a software driver specifically written for this graphics engine. In this arrangement, the CPU (under control of the software driver) typically generates three bits of data (one for each eight bit component of the twenty-four bit color value) for every bit of the raster data. The CPU then sends this triplicated raster data to the rasterizer for processing. The graphics engine has a twenty-four bit "rotating" color register storing the color value, and when performing a write operation to the frame buffer, the graphics engine selects one of the components stored in the color register based on a rotating scheme. In this manner, three successive eight bit write operations (e.g., a red component, a green component, and then a blue component) by the graphics engine transfers one twenty-four bit color value to the frame buffer.

A graphics engine that processes True Color Text may write, for example, thirty-two, sixty-four or one hundred twenty-eight bits to the frame buffer on every clock cycle. For these data transfers, the color values for 1⅓, 2⅔, or 5⅓ pixels, respectively, are transferred at one time to the frame buffer.

SUMMARY OF THE INVENTION

The invention provides a rasterizer that has circuitry for replicating bits of monochrome raster data furnished by a central processing unit (CPU). As a result, an eight, sixteen, thirty-two, or sixty-four bit graphics engine (i.e., a graphics engine that concurrently processes $2^n$ bits) may be used without requiring replicated raster data from the CPU and without writing padded color values to the frame buffer. Thus, the burden of replicating the raster data is shifted to the rasterizer without introducing additional system bandwidth and memory requirements.

In general, in one aspect, the invention features a rasterizer for use with a processor capable of providing raster data indicative of a pattern of pixels to be formed on a display. Each pixel has an attribute represented by a data value. The rasterizer has a replicator connected to form at least two copies of the raster data. A graphics engine is connected to use the at least two copies to store the data values in a memory. An output circuit is connected to use the data values stored in the memory to form the pattern on the display.

In preferred embodiments, the graphics engine is connected to simultaneously transfer portions of at least two data values to the memory, and each data value includes twenty-four bits. The attribute includes a pixel color, and the pattern includes a text character. The rasterizer has a buffer in which the replicator stores the copies of the raster data. The rasterizer formed exactly three copies of the raster data. The raster data has bits, and electrical lines are used to furnish multiple representations of the bits to form the copies. The data values for all pixels of the pattern are the same, and the graphics engine has a buffer for storing a copy of the data value. The copy of the data value stored in the buffer of the graphics engine is used in connection with the transfer of the data value to the memory. The graphics engine selectively uses the contents of the buffer in connection with the transfer of each data value to the memory.

In general, in another aspect, the invention features a method for use with a processor capable of providing raster data indicative of a pattern of pixels to be formed on a display. Each pixel has an attribute that is represented by a data value. The method includes using a rasterizer to form at least two copies of the raster data. The copies are used to store the data values in a memory, and the data values stored in the memory are used to form the pattern on the display.

Other advantages and features will become apparent from the following description and from the claims.

BRIEF DESCRIPTION OF THE DRAWING

FIG. 6 is a chart illustrating entries in the host buffer of FIG. 5.

DESCRIPTION OF THE PREFERRED EMBODIMENTS

Figure 1:
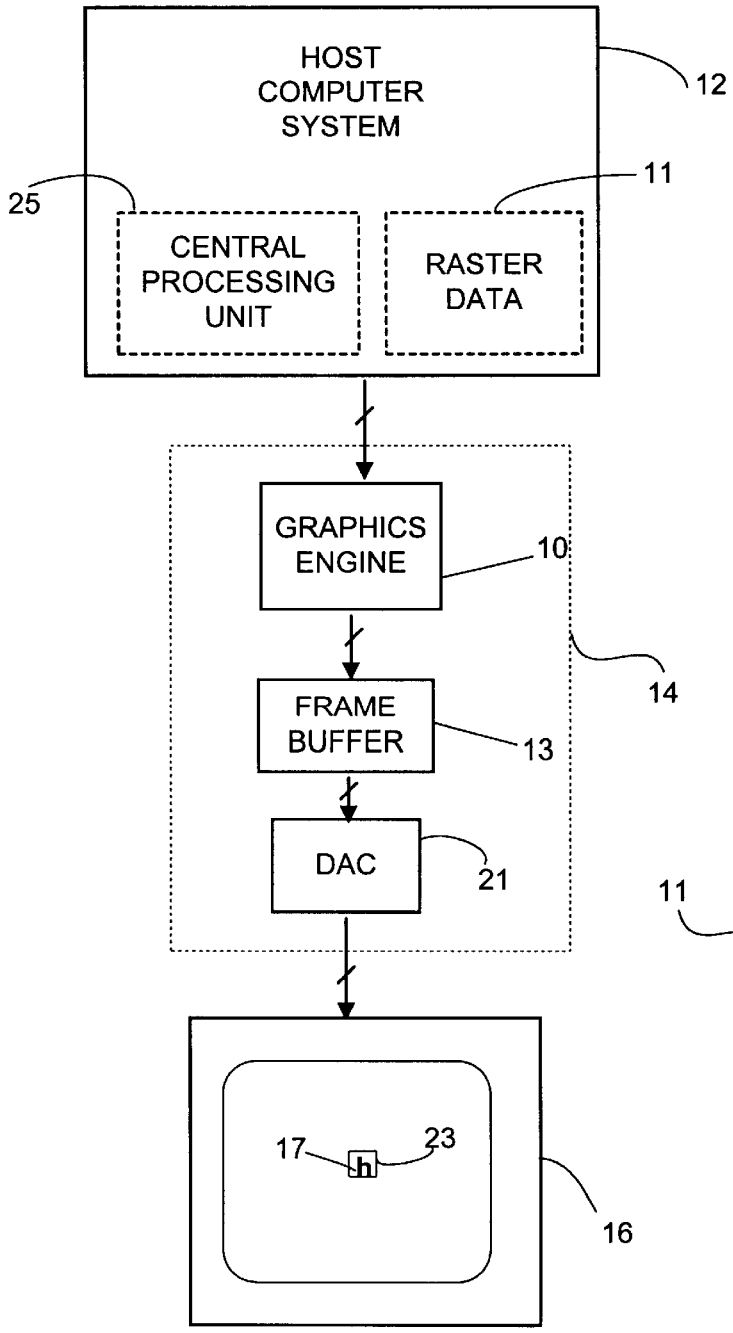
FIG. 1 (PRIOR ART)
FIG. 1 is a block diagram of a graphics system of the prior art.
Figure 2:
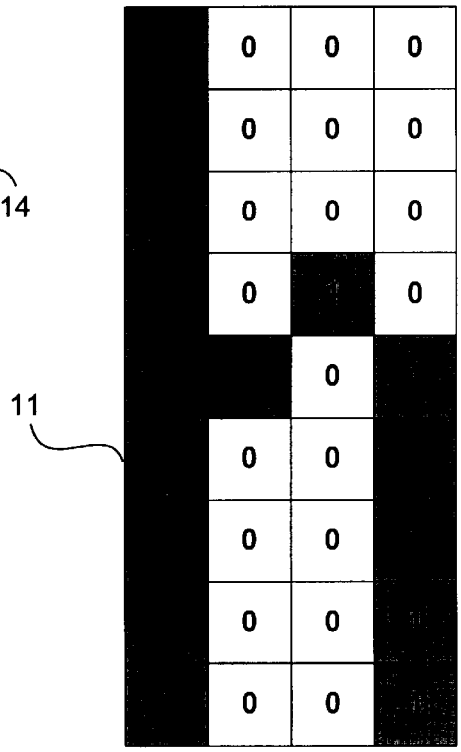
FIG. 2 (PRIOR ART)
FIG. 2 is a chart illustrating monochrome raster data for a text character.
Figure 3:
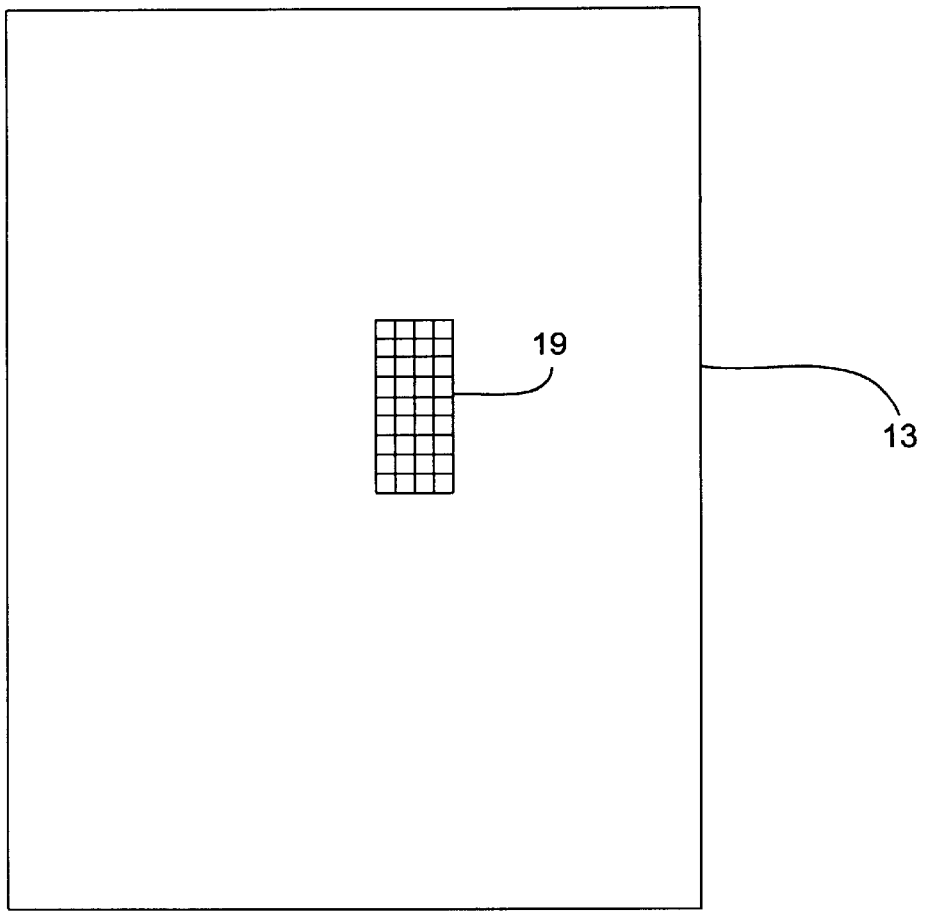
FIG. 3 (PRIOR ART)
FIG. 3 is an illustration of the organization of a frame memory of the graphics system of FIG. 1.
Figure 4:
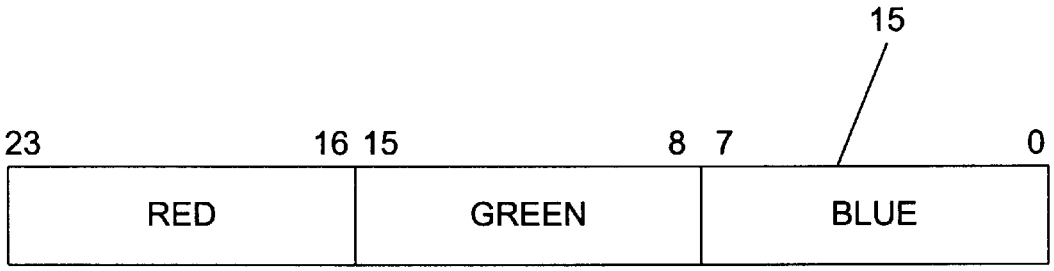
FIG. 4 (PRIOR ART)
FIG. 4 is a chart illustrating a color value for a pixel.
Figure 5:
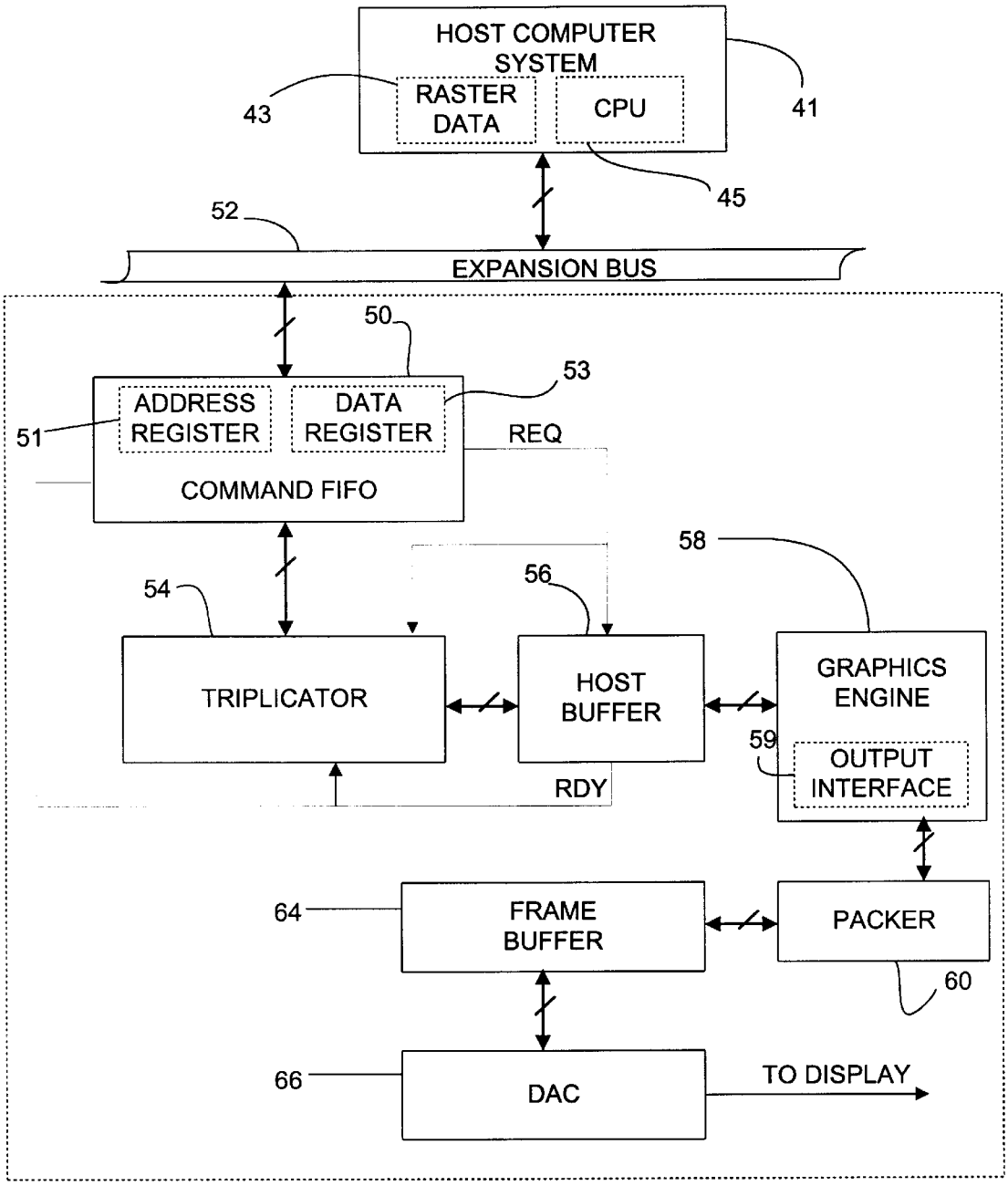
FIG. 5 is a schematic block diagram of a graphics system according to one embodiment of the invention.

As shown in FIG. 5, to produce True Color text (i.e., text requiring a twenty-four bit color value per pixel), a central processing unit (CPU) 45 of a host computer system 41 generates monochrome raster data 43 (data defining a text character) and sends the raster data 43 to a rasterizer 40. The rasterizer 40 uses a thirty-two bit graphics engine 58 to process the True Color text without requiring multiple copies of the raster data 43 (i.e., triplicated raster data) to be furnished by the CPU 45 and without padding the color values stored in a frame buffer 64. To accomplish this, the rasterizer 40 has a triplicator 54 which triplicates each bit of the raster data 43 (i.e., forms three copies of the raster data 43) received from the host computer system 41 to form a resultant set of triplicated bits which are processed by the graphics engine 58. Thus, although the thirty-two bit graphics engine 58 is used to process True Color text, the required memory capacity, memory bandwidth, and CPU overhead in the host computer system 41 are no different than if the graphics engine were a twenty-four bit engine.

The graphics engine 58 processes the triplicated bits, four bits at a time to transfer thirty-two bits at a time to a packer 60 (a temporary storage buffer, as described below) coupled between the graphics engine 58 and the frame buffer 64. In this manner, 1⅓ pixels are transferred to the packer 60 on each clock cycle. As described below, an output interface 59 of the graphics engine 58 preserves the order (red component first, green component, and then blue component) in which the color values are transferred to the packer 60 via the write operations.

The raster data 43 is received (in thirty-two bit chunks) by the rasterizer 40 via a command first-in-first-out (FIFO) 50 coupled to an expansion bus 52 (e.g., a Peripheral Component Interconnect (PCI) bus). The FIFO 50 has an address register 51 for storing a thirty-two bit address and a data register 53 for storing thirty-two bits (i.e., one Dword) of raster data. Because the raster data is written to a predefined range of addresses, the triplicator 54 checks the content of the address register 51 to determine if the data register 53 contains raster data (i.e., is the address in the address register 51 within the predefined range of addresses?). If so, the triplicator 54 triplicates the bits stored in the data register 53 to form an entry of triplicated bits (i.e., a total of 32 sets of triplicated bits or 96 bits) in a ninety-six bit (i.e., 3 Dword) host buffer 56.

To indicate when the host buffer 56 has space available for receiving another entry of triplicated bits, the host buffer 56 and command FIFO 50 communicate via two handshaking signals, REQ and RDY. When the FIFO 50 is not empty, the FIFO 50 asserts, or drives high, the REQ signal to indicate more data is available in the data register 53.

When the host buffer 56 has space available for another entry of triplicated bits, the host buffer 56 asserts, or drives high, the RDY signal which permits the triplicator 54 to transfer (if the register 53 contains raster data) another entry of triplicated bits into the host buffer 56.

For purposes of minimizing delays in the transfer of the color values to the frame buffer 64, the rasterizer 40 has the packer 60. The packer 60 provides temporary storage for the color values and receives one Dword (i.e., the color values for 1⅓ pixels) at a time from the graphics engine 58. If two Dwords received from the graphics engine 58 are written to two consecutive memory locations in the frame buffer 64 and the first of these consecutive memory locations is an even address in the frame buffer 64, then the packer 60 packs the two Dwords together to form a Qword (i.e., 64 bits) which is then transferred at one time to the frame buffer 64. Otherwise, the packer 60 transfers the Dwords (one at time) to the frame buffer 64 without packing the Dwords into Qwords. The rasterizer 40 also has a digital-to-analog converter (DAC) 66 which uses the color values from the frame buffer 64 to form analog signals used 30 to drive a display (not shown).

As shown in FIG. 6, each Dword of raster data retrieved from the register 53 results in a ninety-six bit entry (i.e., three copies of the Dword of raster data) in the host buffer 56. The ordering of the bits in the register 53 is preserved in the triplicated entry in the host buffer 56. As examples, the least significant bit (e.g., "1b", wherein the suffix "b" denotes binary representation) in the register 53 corresponds to the least significant three bits (e.g., "111b") of the entry in the host buffer 56, and the most significant bit (e.g., "0b") in the register 53 corresponds to the three most significant bits (e.g., "000b") in the entry in the host buffer 56.

Figure 7:
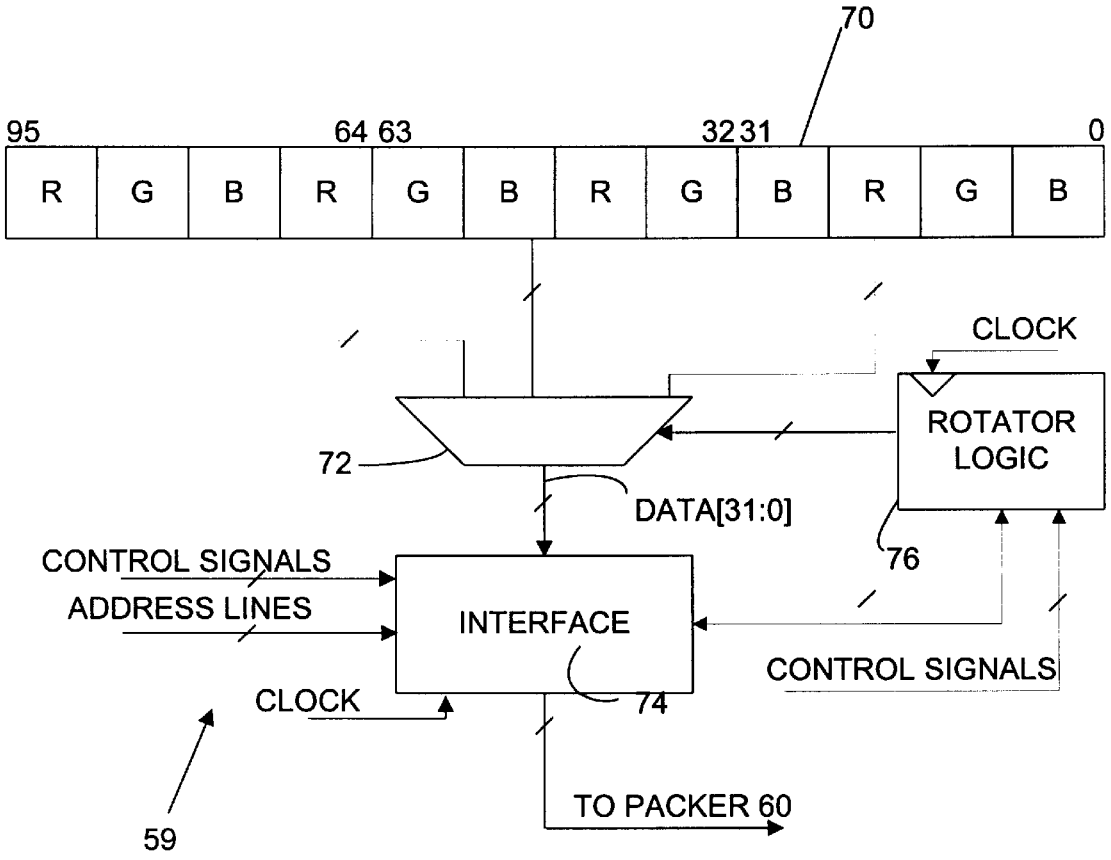
FIG. 7 is a schematic diagram illustrating an output interface of the graphics engine of FIG. 5.

As shown in FIG. 7, the output interface 59 of the graphics engine 58 includes a ninety-six bit color register 70 (i.e., a "rotating color register") which contains a triplicated representation (in bits 0–23, 24–47, 48–71, and 72–95) representation of a twenty-four bit color value (i.e., the red, green, and blue components) which represents the foreground color of the character. The color value may be changed via a write operation (to a predetermined address) to the command FIFO 50 by the host computer system 41.

Because the graphics engine 58 performs thirty-two bit write operations (all four bytes written to successive memory locations) to store more than one twenty-four bit color value at a time in the packer 60, the output interface 59 has rotator logic 76. The rotator logic 76 interacts with a multi-bit multiplexer 72 to select a different set of thirty-two bits (bits 0–31, 32–63, or 64–95) of the register 70 (as indicated by bits DATA[31:0]) for each write operation to the packer 60. The bits DATA[31:0] are provided to a packer interface 74 that performs the transfer of the bits DATA [31:0] to the packer 60. The logical level (i.e., "0" or "1") of the triplicated bits serve as byte enables for the thirty-two bit transfers to the packer 60. The packer 60 uses the same byte enables to transfer the color values to the frame buffer 64. For example, when the graphics engine 58 encounters "0000b" nothing is written (for four bytes) to the packer 60 (or frame buffer 64).

Thus, for each thirty-two bits transferred from the graphics engine 58 to the packer 60, the possible ordering could be BGRB (bits 0–31 of the register 70), GBRG (bits 32–63 of the register 70), or RGBR (bits 64–95 of the register 70,) where "B" indicates the eight bit blue component, "G" indicates the eight bit green component, and "R" indicates the eight bit red component of the color value.

Figure 8:
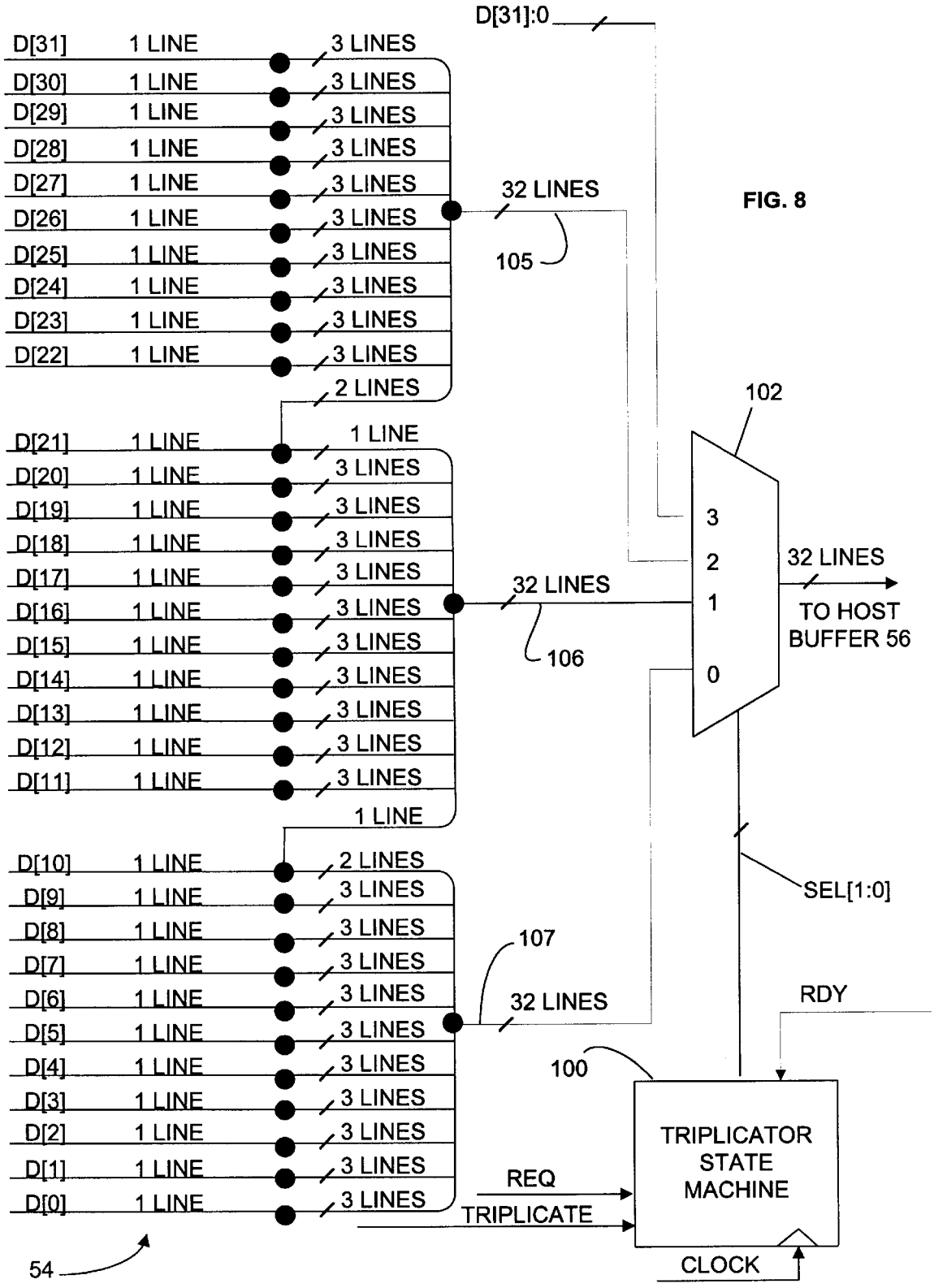
FIG. 8 is a schematic diagram of the triplicator of FIG. 5.

As shown in FIG. 8, to triplicate the raster data present in the data register 53 to form the entry of triplicated bits in the host buffer 56, the triplicator 54 fans out the bits D[31:0] of the data register 53 onto three sets 105, 106, and 107 of thirty-two lines (96 lines total). One set 105 of lines furnishes the most significant Dword of the entry stored in the host buffer 50, another set 106 of lines furnishes the second most significant Dword of the entry stored in the host buffer 56, and the third set 107 of lines furnishes the least significant Dword of the entry stored in the host buffer 56.

A multi-bit multiplexer 102 receives the three sets 105–107 of lines through inputs two, one, and zero, respectively. Input three of the multiplexer 102 receives the bits D[31:0] directly from the data register 53. When the triplicator 54 is enabled, a triplicator state machine 100 interacts with the multiplexer 102 to selectively furnish the entry of triplicated bits to the host buffer 56. When the triplicator 54 is disabled, the triplicator state machine 100 interacts with the multiplexer 102 to furnish the contents of the register 53 directly to the host buffer 56. The triplicator 54 might be disabled, for example, to pass a new color value to the register 70.

The triplicator state machine 100 furnishes a two bit select signal called SEL[1:0] to the select input of the multiplexer 102. The triplicator state machine 100 receives the REQ and RDY signals. The triplicator state machine 100 also receives a signal called TRIPLICATE (a signal representative of a bit in a configuration register) which when asserted, or driven high, enables the triplicator 54. The deassertion, or driving low, of the TRIPLICATE signal disables the triplicator 54.

To form the triplicated entry of data, the bits D[9:0] are each furnished to three of the set 105 of lines. The bit D[10] is furnished to two of the set 105 of lines and to one of the set 106 of lines. The bits D[20:11] are each furnished to three of the set 106 of lines. The bit D[21] is furnished to one of the set 106 of lines and to two of the set 105 of lines. The bits D[31:22] are each furnished to three of the set 105 of lines.

Figure 9:
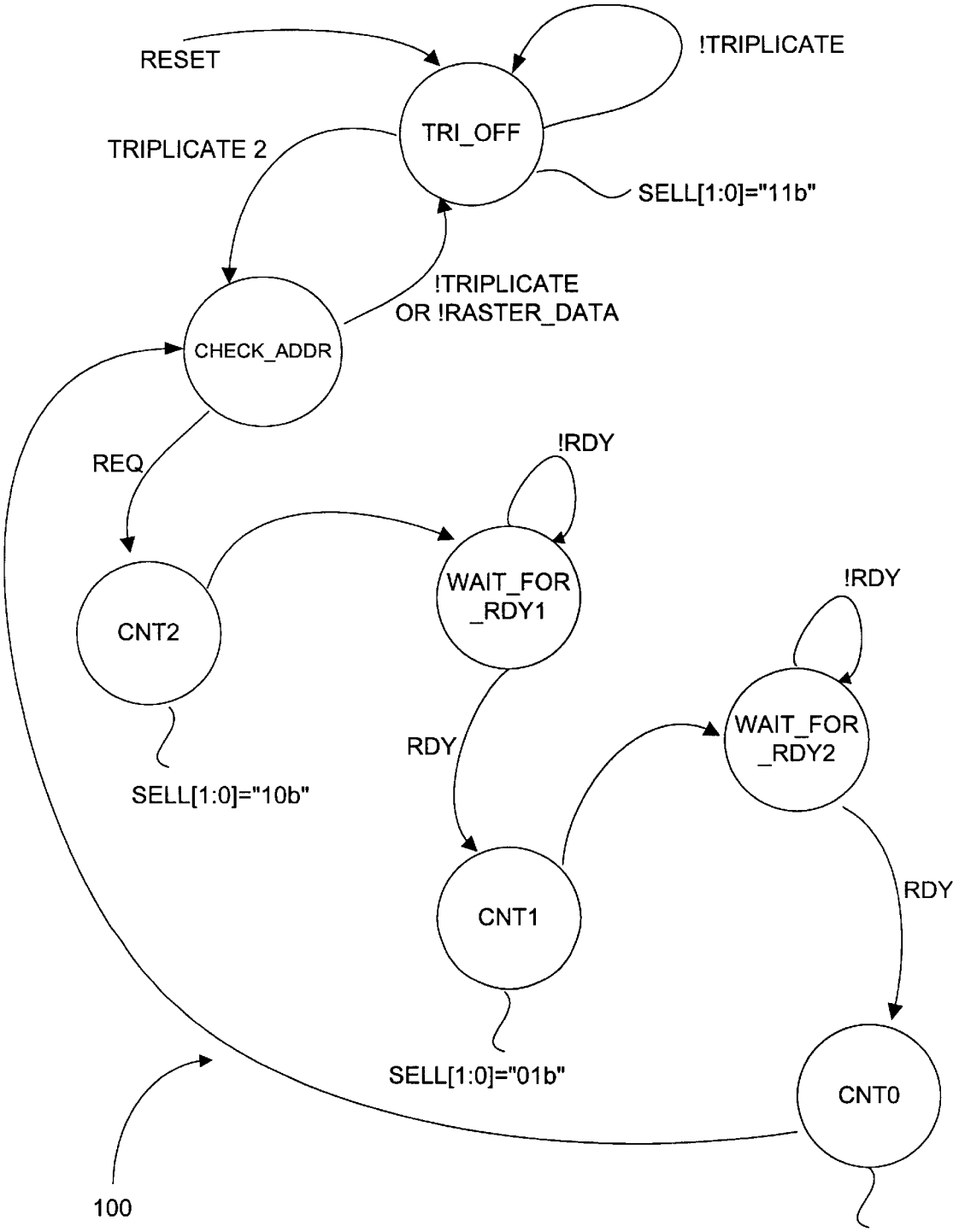
FIG. 9 is a state diagram of the triplicator state machine of FIG. 8.

As shown in FIG. 9, on reset of the rasterizer 40, the triplicator state machine 100 enters a state called TRI_OFF. The triplicator state machine 100 remains in the TRI_OFF state until the TRIPLICATE signal is asserted, thereby indicating the enablement of the triplicator 54. During the TRI_OFF state, the SEL[1:0] signals are equal to "11b" (wherein the suffix "b" indicates binary representation) and the data from the data register 53 is furnished directly to the host buffer 56.

After leaving the TRI_OFF state, the triplicator state machine 100 enters a state called CHECK_ADDR in which the triplicator state machine 100 checks the address in the address register 51 to determine if the contents of the data register 53 contains raster data. If not, or if the TRISTATE signal has been negated, the triplicator state machine 100 returns to the TRI_OFF state.

If the data register 53 contains raster data, then the triplicator state machine 100 begins the process of forming a triplicated entry in the host buffer 56. To accomplish this, the triplicator state machine 100 first transitions to a state called CNT2 in which the triplicator state machine 100 sets the SEL[1:0] signals equal to "10b" to transfer the bits associated with the set 107 of lines to the host buffer 56. The triplicator state machine 100 then transitions to a state called WAIT_FOR_RDY1 in which the triplicator state machine 100 wait for the RDY signal to be asserted by the host buffer 56. When the RDY signal is asserted, the triplicator state machine 100 transitions to a state called CNT1.

In the state CNT1, the triplicator state machine 100 sets the SEL[1:0] signals equal to "01b" to transfer the bits associated with the set 106 of lines to the host buffer 56. The triplicator state machine 100 then transitions to a state called WAIT_FOR_RDY2 in which the triplicator state machine 100 waits for the host buffer 56 to assert the RDY signal. Once the RDY signal is asserted, the triplicator state machine 100 transitions to a state called CNT0.

In the state CNT0, the triplicator state machine 100 sets the SEL[1:0] signals equal to "00b" to transfer the bits associated with the set 105 of lines to the host buffer 56. Once completed, the triplicator state machine 100 transitions back to the CHECK_ADDR state.

Other embodiments are within the scope of the following claims. For example, the graphics engine 58 might be a sixty-four bit graphics engine programmed to operate in an eight bit mode. The triplicator 56 may be replaced with a replicator capable of generating any desired number of copies of the raster data. The rasterizer might process text having a color value of sixteen bits by duplicating the raster data.

What is claimed is:

1. A rasterizer comprises:

a replicator connect to receive raster data and to produce therefrom replicated raster data, wherein the raster data includes information for a block of pixels; and a graphics engine connected to receive the replicated raster data and to produce therefrom color data for each of the pixels of the block of pixels, wherein the graphics engines provides the color data for at least a portion of one pixel and a portion of another pixel to a frame buffer during a clock cycle.

2. The rasterizer of claim 1 wherein the graphics engine further comprises an output interface operable to select one of a plurality of sets of bits to represent the color data for the at least a portion of the one pixel and the portion of the another pixel based on a current portion of the replicated raster data, and wherein the plurality of sets of bits includes a red-green-blue-red set, a green-blue-red-green set, and blue-red-green-blue set.

3. The rasterizer of claim 1 wherein the color data comprises twenty-four bits and the color data for the at least a portion of the one pixel and the portion of the another pixel is provided to the frame buffer in thirty-two, sixty-four, or one hundred twenty-eight bit blocks.

4. The rasterizer of claim 1, further comprising:

a buffer, and wherein, the replicator stores the replicated raster data in the buffer.

5. The rasterizer of claim 1 wherein the replicator produces the replicated raster data by generating three copies of the raster data.

6. The rasterizer of claim 1 wherein the replicator further comprises a state machine and multiplexor, wherein the state machine controls production of the replicated raster data based on control signals, wherein the control signals cause the replicator to be in an off state, a check address state, control states, or wait states.

7. A method for processing raster data, the method comprising:

receiving a single copy of the raster data;

producing replicated raster data from the raster data, wherein the raster data includes information for a block of pixels;

producing color data for each of the pixels of the block of pixels based on the replicated raster data; and providing the color data for at least a portion of one pixel and a portion of another pixel to a frame buffer during a clock cycle.

8. The method of claim 7, wherein the step of producing the color data further comprises selecting one of a plurality of sets of bits to represent the color data for the at least a portion of the one pixel and the portion of the another pixel based on a current portion of the replicated raster data, and wherein the plurality of sets of bits includes a red-green-blue-red set, a green-blue-red-green set, and blue-red-green-blue set.

* * * * *